US008082913B2

(12) United States Patent
Lian

(10) Patent No.: US 8,082,913 B2
(45) Date of Patent: Dec. 27, 2011

(54) STRIKER FOR PAINT BALL GUN

(75) Inventor: Sheng-Jen Lian, Fongyuan (TW)

(73) Assignee: Yao-Gwo Gan, Taichung County (TW)

( * ) Notice: Subject to any disclaimer, the term of this patent is extended or adjusted under 35 U.S.C. 154(b) by 744 days.

(21) Appl. No.: 12/139,451

(22) Filed: Jun. 13, 2008

(65) Prior Publication Data

US 2009/0308370 A1 Dec. 17, 2009

(51) Int. Cl.
*F41B 11/00* (2006.01)

(52) U.S. Cl. ..... 124/80; 124/76

(58) Field of Classification Search ..... 124/73–77, 124/80

See application file for complete search history.

(56) References Cited

U.S. PATENT DOCUMENTS

| | | | | |
|---|---|---|---|---|
| 5,063,905 | A * | 11/1991 | Farrell | 124/72 |
| 6,832,605 | B2 * | 12/2004 | Farrell | 124/76 |
| 7,111,621 | B2 * | 9/2006 | Lin | 124/74 |
| 7,150,276 | B1 * | 12/2006 | Rice | 124/73 |
| 7,398,776 | B2 * | 7/2008 | Casas Salva | 124/74 |
| 7,621,265 | B2 * | 11/2009 | Halmone | 124/74 |
| 7,726,293 | B2 * | 6/2010 | Wei | 124/74 |
| 2002/0129806 | A1 * | 9/2002 | Kim | 124/74 |
| 2005/0011508 | A1 * | 1/2005 | Kunimoto | 124/73 |
| 2006/0027224 | A1 * | 2/2006 | Lin | 124/70 |
| 2007/0181116 | A1 * | 8/2007 | Wei | 124/74 |
| 2010/0108049 | A1 * | 5/2010 | Dobbins | 124/77 |
| 2010/0126486 | A1 * | 5/2010 | Halmone et al. | 124/74 |
| 2010/0263652 | A1 * | 10/2010 | Maeda et al. | 124/73 |

* cited by examiner

*Primary Examiner* — Troy Chambers
(74) *Attorney, Agent, or Firm* — Shimokaji & Associates, P.C.

(57) ABSTRACT

A paint ball gun includes a body, a valve unit and a striking unit. The valve unit is disposed in the body. The striking unit is disposed in the body, and includes a striker and a collar. The striker is made of metal and formed with a striking tip at an end for hitting the valve unit. The collar is made of plastics and provided on the striking tip.

7 Claims, 4 Drawing Sheets

STRIKER FOR PAINT BALL GUN

FIELD OF INVENTION

The present invention relates to a paint ball gun and, more particularly, to a light and inexpensive striking unit for a paint ball gun.

BACKGROUND OF INVENTION

A paint ball gun includes a barrel, a bullet ejector, a body, a valve set, a striker and a trigger. The barrel is in communication with the body so that air can go into the barrel from the body. The bullet ejector is movable in the barrel. The valve set is disposed in the body so that the air can only go into the barrel from the body through the valve set. The valve set includes a plunger movable in a housing. The striker is movable in the body. The trigger is operable to make the striker strike the plunger so that the air can go through the housing. The striker is generally made of hard metal since it has to take recoil. There are however problems with the striker. Firstly, it is heavy and expensive. Secondly, it requires a large force to actuate the striker, and the recoil is therefore large.

The present invention is therefore intended to obviate or at least alleviate the problems encountered in prior art.

SUMMARY OF INVENTION

It is the primary objective of the present invention to provide a light and inexpensive striking unit for a paint ball gun.

To achieve the foregoing objective, the paint ball gun includes a body and a valve unit. The valve unit is disposed in the body. The striking unit is disposed in the body, and includes a striker and a collar. The striker is made of metal and formed with a striking tip at an end for hitting the valve unit. The collar is made of plastics and provided on the striking tip.

Other objectives, advantages and features of the present invention will become apparent from the following description referring to the attached drawings.

BRIEF DESCRIPTION OF DRAWINGS

The present invention will be described via the detailed illustration of the preferred embodiment referring to the drawings.

DETAILED DESCRIPTION OF PREFERRED EMBODIMENT

Figure 1:
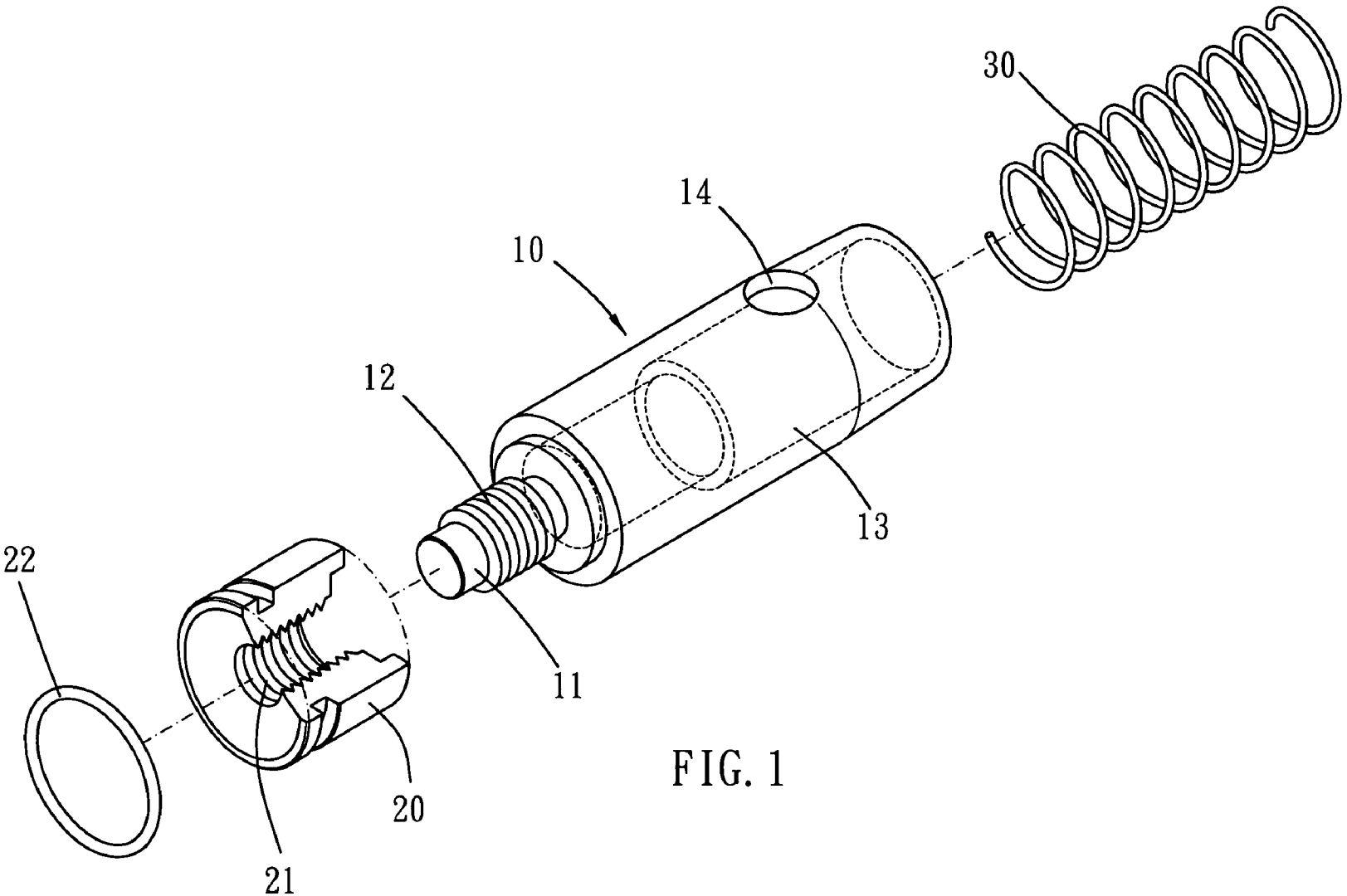
FIG. 1 is an exploded view of a striking unit according to the preferred embodiment of the present invention.
Figure 2:
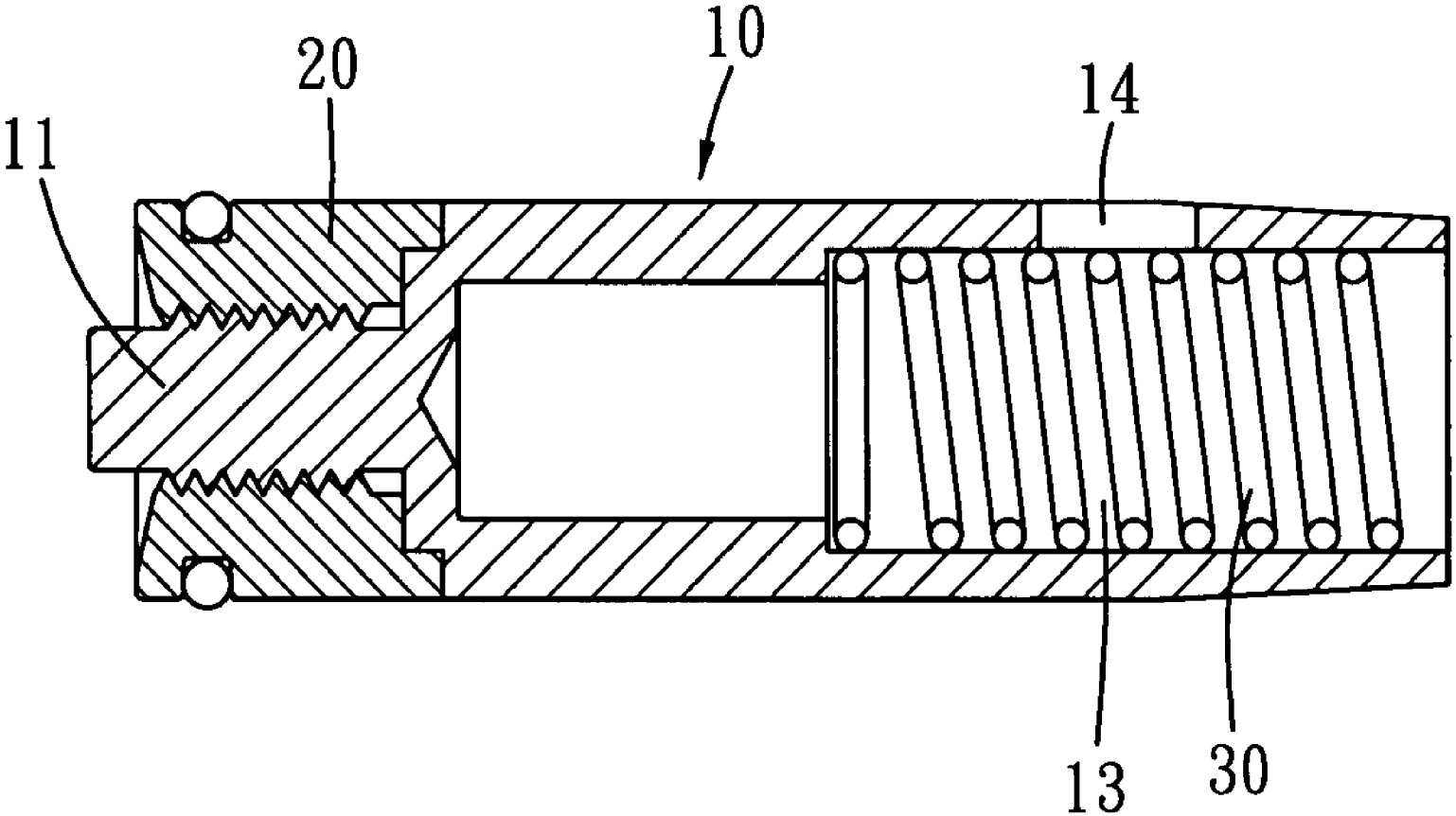
FIG. 2 is a cross-sectional view of the striking unit shown in FIG. 1.
Figure 3:
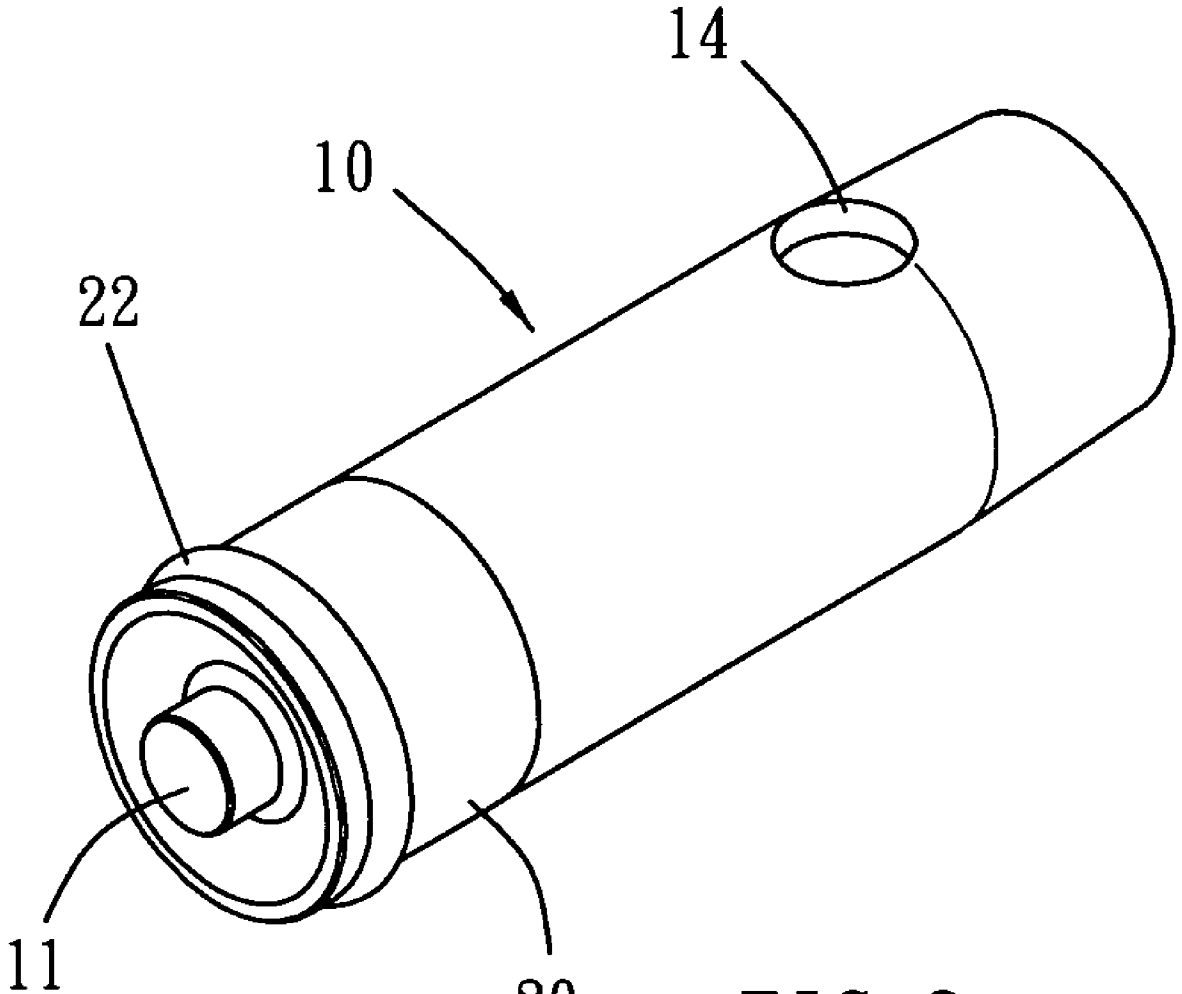
FIG. 3 is a perspective view of the striking unit shown in FIG. 1.

Referring to FIGS. 1 to 3, there is shown a striking unit according to the preferred embodiment of the present invention. The striking unit includes a striker 10, a collar 20 and an elastic element 30. The striker 10 is made of hard metal. The striker 10 includes a striking tip 11 formed at an end, a recess 13 defined in an opposite end and an aperture 14 in communication with the recess 13. More particularly, the recess 13 is defined by the striker 10 in an end opposite to the striking tip 11. The striking tip 11 is formed with a thread 12. The recess 13 is made with a stepped form including a first section and a second section. The diameter of the first section of the recess 13 is smaller than that of the second section.

The collar 20 is made of a strong, light material such as aluminum and plastics. The collar 20 is provided around the striking tip 11 so that the striking tip 11 extends beyond the collar 20. The collar 20 is formed with a thread 21 on an internal side thereof. The thread 21 is engaged with the thread 12 so that the collar 20 is secured to the striking tip 11. That is to say, the collar 20 is firmly disposed on the striking tip of the striker 10. In other words, the collar 20 would be moved together with the striker 10. A ring 22 is provided around the collar 20. Preferably, the collar 20 includes a groove for receiving the ring 22.

The elastic element 30 is preferably a helical spring. The elastic element 30 is formed with an end received in the second section of the recess 13 and an opposite end located outside the striker 10. Furthermore, the elastic element 30 abuts against the first section of the recess 13.

Figure 4:
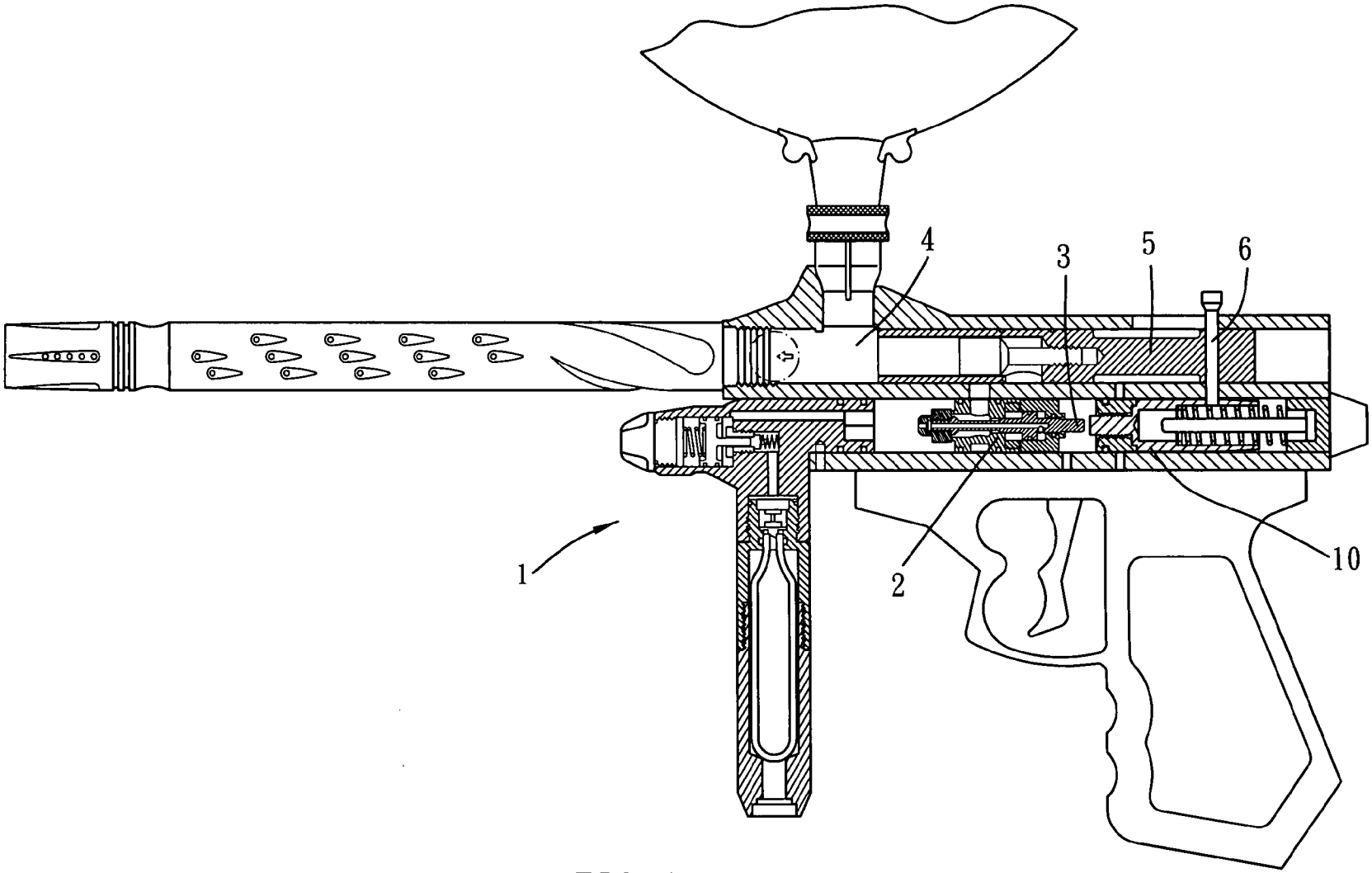
FIG. 4 is a cross-sectional view of a paint ball gun including the striking unit shown in FIG. 1.

Referring to FIG. 4, there is shown a paint ball gun using the striking unit according to the preferred embodiment of the present invention. The paint ball gun includes a body 1, a valve set, a barrel 4, a bullet ejector 5, a connecting rod 6 and a trigger. The body 1 is in communication with the barrel 4 so that air can go into the barrel 4 from the body 1. The valve set is disposed in the body 1 so that the air can only go into the barrel 4 from the body 1 through the valve set. The valve set includes a plunger 3 movable in a housing 2. The striking unit is movable in the body 1. The bullet ejector 5 is movable in the barrel 4. The connecting rod 6 is inserted through a tunnel defined in the bullet ejector 5 and the aperture 14 defined in the striker 10 so that the striker 10 is connected to the bullet ejector 5. The trigger is operable to cause the striking unit to move the plunger 3 so that the air can go through the housing 2.

When the trigger is not operated, the bullet ejector 5 and the striker 10 are located in rear positions in the barrel 4 and the body 1, respectively. When the trigger is operated, the elastic element 30 causes the striker 10 to move towards the valve set so that the striking tip 11 hits the plunger 3. Therefore, the air goes into the barrel 4 from the body 1 through the housing 2. The bullet ejector 5 moves together with the striker 10 since they are joined together. The bullet ejector 5 hits a bullet and the air blows the bullet, thus firing the bullet from the barrel 4.

The diameter of the striking tip 11 is smaller than the remaining 11 portion of the striker 10. Thus, the striker 10 is smaller than a striker with the diameter of the remaining portion of the striker 10 and the length of the striker 10. The collar 20 is lighter than a counterpart with the size thereof but of the material of the striker 10. Thus, the striking unit is light. Therefore, recoil against a user is weak. The striking unit is inexpensive because it is partially made of plastics.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A paint ball gun-used striking unit comprising:

a striker made of metal and formed with a striking tip at an end; and a collar made of a light material and provided around the striking tip at one end of the striker, the collar being firmly disposed on the striking tip at one end of the striker;

wherein the collar is formed with a thread on an internal aide, and the striking tip comprises a thread formed thereon and engaged with the thread of the collar, so that the collar is secured to the striking tip.

2. The striking unit according to claim 1, wherein a recess is defined by the striker in an end opposite to the striking tip, the recess is adapted for receiving an elastic element.

3. The striking unit according to claim 1, wherein the striking unit further comprises a ring provided around the collar, a groove is defined by the collar, and the ring is received in the groove.

4. The striking unit according to claim 2, wherein the recess is formed stepped, the recess comprises a first section for abutting against the elastic element and a second section for receiving an end of the elastic element, and diameter of the first section is smaller than diameter of the second section.

5. The striking unit according to claim 1, wherein the collar is made of plastics.

6. The striking unit according to claim 1, wherein the collar is made of aluminum.

7. The striking unit according to claim 1, wherein the striker comprises an aperture defined thereon for receiving a connecting rod, the aperture is in communication with the recess.

* * * * *